US006079655A

United States Patent [19]

Halbheer

[11] Patent Number: 6,079,655

[45] Date of Patent: Jun. 27, 2000

[54] INLET ELEMENT ARRANGEMENT FOR A SPIN DRAW WINDER

[75] Inventor: Rudolf Halbheer, Bülach, Switzerland

[73] Assignee: Maschinenfabrik Rieter AG, Winterthur, Switzerland

[21] Appl. No.: 09/143,830

[22] Filed: Aug. 31, 1998

[30] Foreign Application Priority Data

Oct. 8, 1997 [CH] Switzerland ..... 2351/97

[51] Int. Cl.[7] ..... B65H 51/20

[52] U.S. Cl. ..... 242/364.11; 242/364.12; 242/366.2; 226/189

[58] Field of Search ..... 242/364.11, 364.12, 242/364.2, 364.3, 365.6, 366.2; 226/189

[56] References Cited

U.S. PATENT DOCUMENTS

| | | | |
|---|---|---|---|
| Re. 29,959 | 4/1979 | Schippers et al. . | |
| 2,442,336 | 6/1948 | Bauer | 242/364.11 |
| 2,623,240 | 12/1952 | McDermott | 242/364.11 X |
| 3,949,041 | 4/1976 | Schwarz | 264/168 |
| 4,293,518 | 10/1981 | Bethay, Jr. | 264/210.2 |
| 4,825,517 | 5/1989 | Hagler | 28/220 |
| 5,136,763 | 8/1992 | Nugent | 242/364.12 X |
| 5,343,601 | 9/1994 | Schippers . | |
| 5,664,307 | 9/1997 | Stitz et al. | 28/241 |

FOREIGN PATENT DOCUMENTS

| | | | |
|---|---|---|---|
| 0046815 | 3/1982 | European Pat. Off. . | |
| 0539866 A2 | 5/1993 | European Pat. Off. . | |
| 0539866 A3 | 5/1993 | European Pat. Off. . | |
| 1959034 | 6/1971 | Germany . | |
| 29612648 | 10/1996 | Germany . | |
| 63-97579 | 4/1998 | Japan | 242/364.2 |

OTHER PUBLICATIONS

EPO Search Report, Apr. 14, 1998.
German Patent Office Search Report.
Patent Abstract of Japan No. 03287809, Dec. 18, 1991.

*Primary Examiner*—Donald P. Walsh
*Assistant Examiner*—Minh-Chau Pham
*Attorney, Agent, or Firm*—Dority & Manning

[57] ABSTRACT

The invention concerns an arrangement of inlet elements in a spin draw winding machine in which filament bundles (5, 6) guided parallel are deflected by a roll each and are taken off therefrom in which arrangement further rolls can be provided upstream from the transfer point of the filament bundles to a draw roll (4). In this arrangement, the difference between the wrapping angles of each filament bundle on the roll, or on the rolls respectively, is not to exceed 50% of the smaller wrapping angle for either of the filament bundles. Furthermore, it proves advantageous if the sum of all wrapping angles for each filament bundle is about 120 degrees or more.

9 Claims, 3 Drawing Sheets

INLET ELEMENT ARRANGEMENT FOR A SPIN DRAW WINDER

BACKGROUND OF THE INVENTION

The present invention concerns an arrangement of inlet elements in a spin draw winding machine for simultaneously drawing two bundles of fibrils comprising at least one roll for taking over the bundles of fibrils and subsequently arranged draw rolls.

A spin draw winding machine of the type mentioned is known from a German Utility DE 29 612 648 U1. In the arrangement described therein two filament bundles jointly are taken over by one roll and are transferred to a drawing arrangement in which a plurality of pairs of draw rolls are provided.

Furthermore, it is known as such that the two filament bundles before they can be taken over by the roll are deflected in such a manner upstream from the roll. Such deflections present disadvantages in that, as a rule, stationary deflecting elements are provided on which the deflection of the filament bundles generates friction which causes the fibrils located next to the deflecting surface to be heated compared to the outer fibrils not in contact with the deflecting element, in such a manner that irregularities may occur in the filament bundle which are detrimental for the end product.

Such disadvantages make themselves felt particularly if the final yarn produced is applied as a technical yarn.

OBJECTS AND SUMMARY OF THE INVENTION

It thus is a goal of the present invention to create good take-off conditions for both filament bundles. Additional objects and advantages of the invention will be set forth in part in the following description, or may be obvious from the description, or may be learned through practice of the invention.

The goals are achieved according to the characteristics of the invention as set forth in the appended claims.

BRIEF DESCRIPTION OF THE FIGURES

The present invention is explained in the sense of examples in more detail in the following with reference to the FIGS. 1 through 8 and 1A through 5A. It is shown in the:

FIG. A A state of the art hampered by disadvantages.

FIG. B A detail of a variant embodiment according to the FIG. A.

Figure 1:
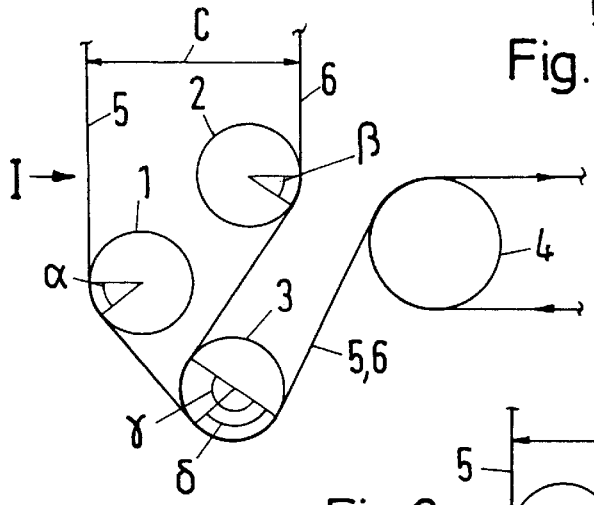
Figure 1:
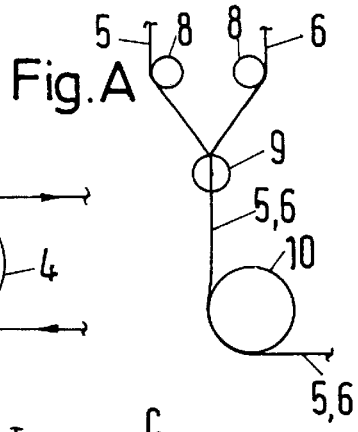
Figure 1:
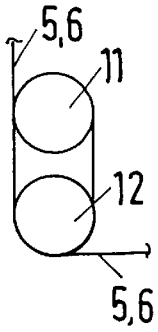
Figure 2:
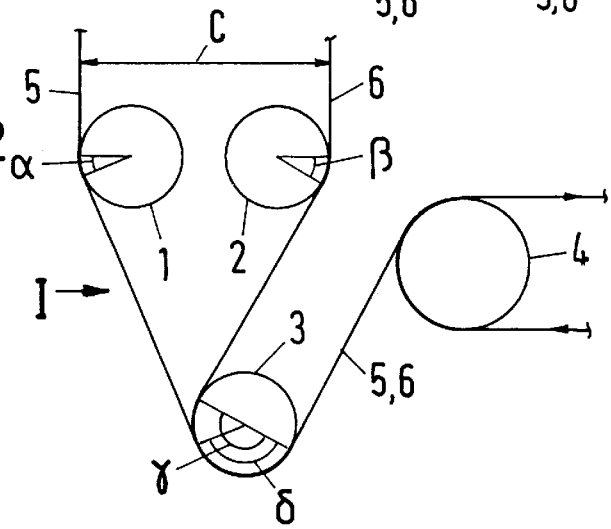
Figure 3:
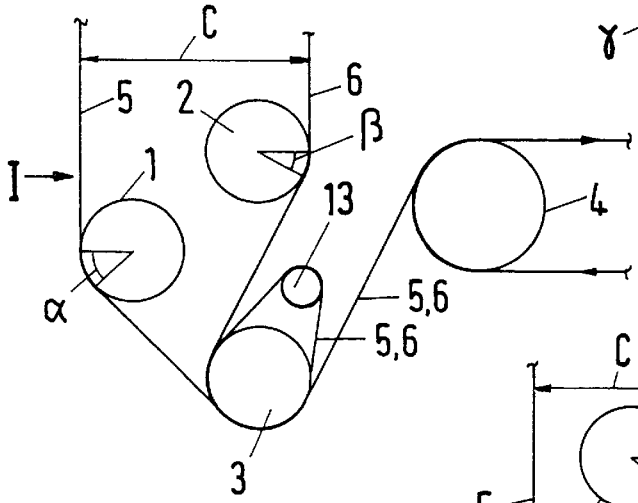
Figure 4:
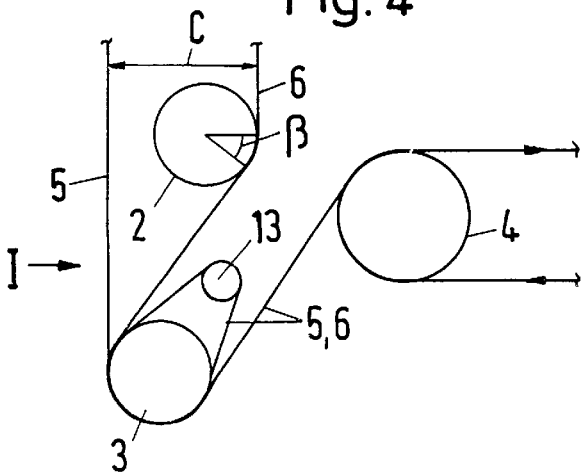
Figure 1A:
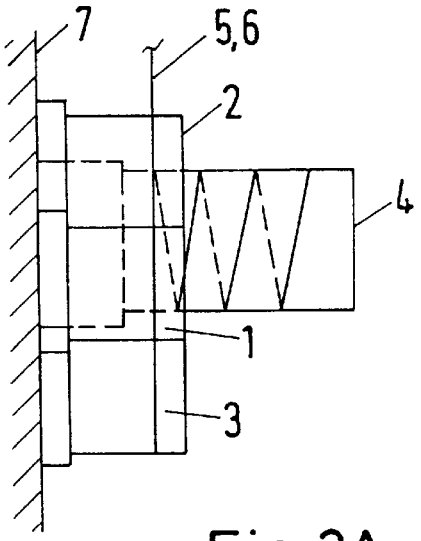
Figure 2A:
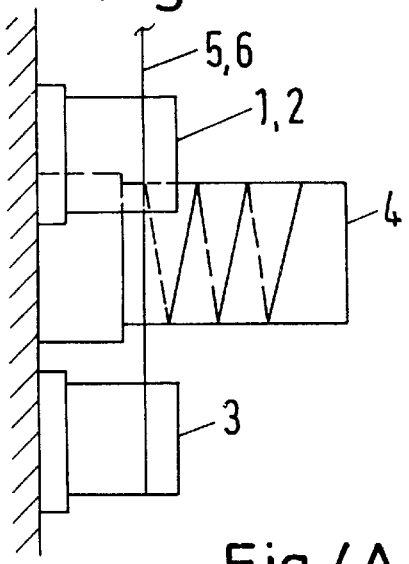
Figure 3A:
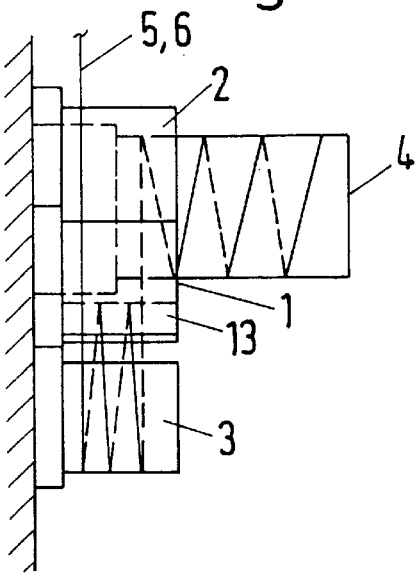
Figure 4A:
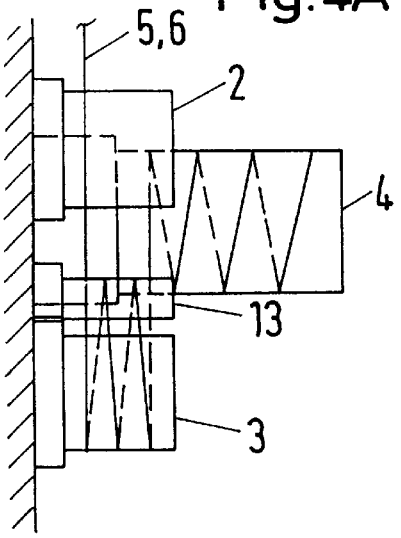
Figure 5A:
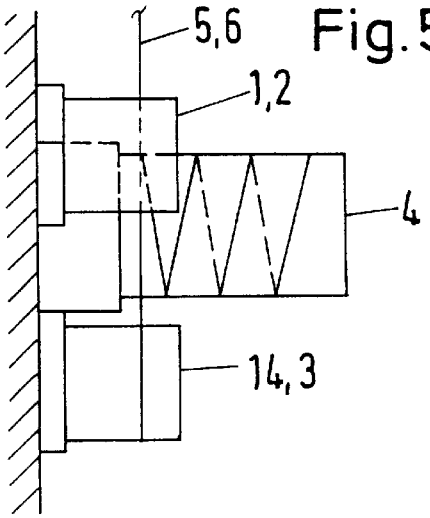
Figure 5:
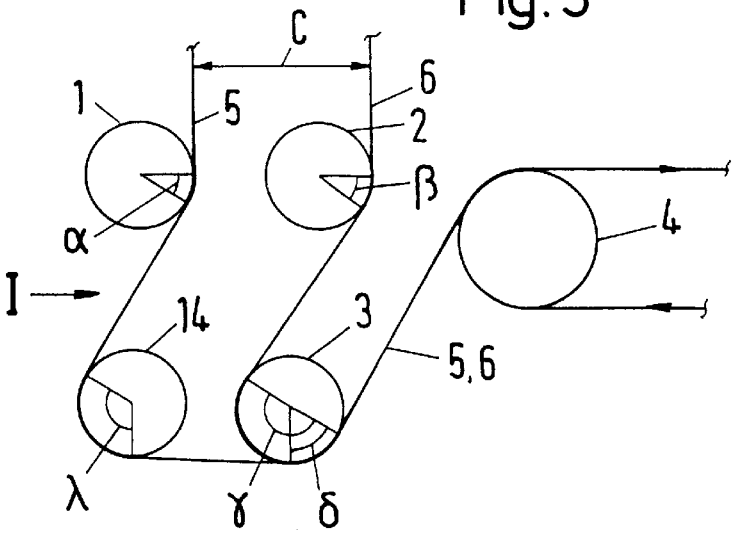
Figure 6:
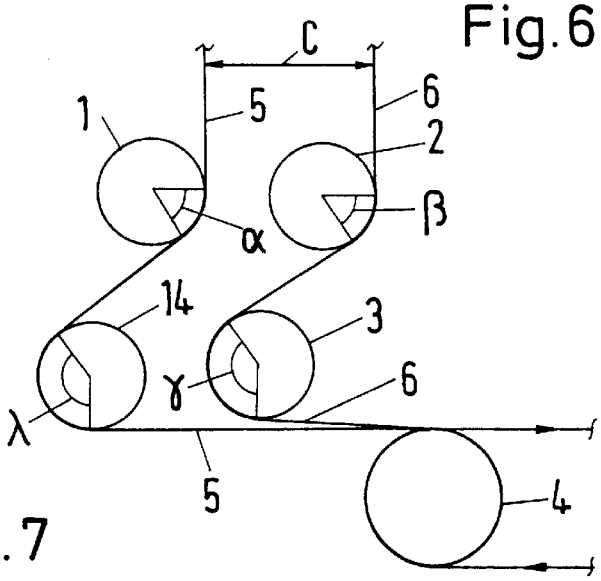
Figure 7:
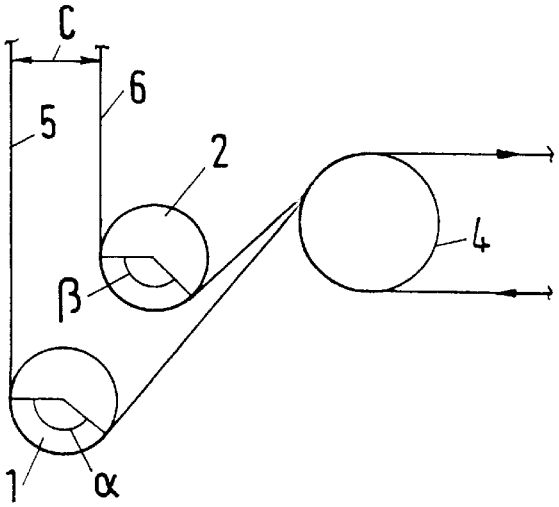
Figure 8:
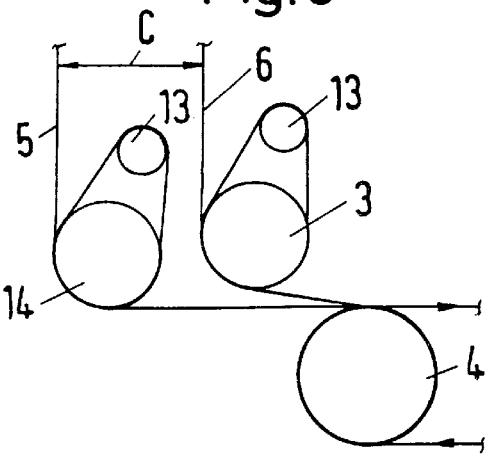

FIG. 1 is a schematic view of an embodiment according to the present invention;

FIG. 1*a* is a side view of the embodiment illustrated in FIG. 1;

FIG. 2 is a schematic view of an alternative embodiment according to the invention;

FIG. 2*a* is a side view of the embodiment illustrated in FIG. 2;

FIG. 3 is a schematic view of an alternative embodiment according to the invention;

FIG. 3*a* is a side view of the embodiment illustrated in FIG. 3;

FIG. 4 is a schematic view of an alternative embodiment according to the invention;

FIG. 4*a* is a side view of the embodiment illustrated in FIG. 4;

FIG. 5 is a schematic view of an alternative embodiment according to the invention;

FIG. 5*a* is a side view of the embodiment illustrated in FIG. 5;

FIG. 6 is a schematic view of an alternative embodiment according to the invention;

FIG. 7 is a schematic view of an alternative embodiment according to the invention; and FIG. 8 is a schematic view of an alternative embodiment according to the present invention.

DETAILED DESCRIPTION

State of the Art

In the FIG. A, a take-off roll is shown which takes over a bundle of fibrils 5 and a bundle of fibrils 6 and transfers it to a drawing arrangement (not shown). The bundles of fibrils 5 and 6 extending parallel are brought together by means of stationary deflecting elements 8 and 9 and jointly are transferred to the take-off roll 10.

In the FIG. B a double roll is shown consisting of the rolls 11 and 12 instead of a single roll.

Invention

General Remarks

In the FIGS. 1 through 8 eight different variant embodiments are shown in principle for taking over two bundles of fibrils in parallel using one or a plurality of rolls, namely depending on the distance between the bundles of fibrils, or on the position of the rolls relative to the draw rolls 4, or on the wrapping angle desired between the entry of the bundles of fibrils on the first roll and the exit on the same, or the last, roll upstream from the roll 4 of the drawing arrangement.

The variant embodiments according to the FIGS. 2, 5 and 6 each present the advantage that the rolls 1 and 2 taking up the bundles of fibrils 5 and 6 are arranged horizontally at the same height level which yields the advantage that the distances between the arrangement of spinnerets (not shown) to the rolls taking over the bundles of filaments are equal.

Practically the same advantage is achieved in the variant embodiment according to the FIG. 8.

The variant embodiments according to the FIGS. 6, 7, and 8 present the advantage that the total wrapping angle each is the same for both bundles of fibrils.

The variant embodiments according to the FIGS. 3, 4 and 8 in which double rolls are provided present the advantage that owing to the multiple wraps around the double rolls (see the FIGS. 3A and 4A), the difference between the total wrapping angles of each bundle of fibrils percentage-wise is smaller compared to arrangements in which single rolls are provided as shown in the FIGS. 1, 2 and 5.

Description of the Figures

In the FIG. 1, a roll 1 is shown for a bundle of fibrils 5 and a roll 2 for a bundle of fibrils 6 which each are supplied by a spinneret arrangement (not shown).

The fibrils produced in a spinneret arrangement are combined into a bundle of fibrils in a manner known as such.

After leaving the rolls 1 and 2, the bundles of fibrils 5 and 6 are taken over by a roll 3 and are transferred to a draw roll 4. Draw rolls of such type are known e.g. from the DE 296 12 648 U1 cited above in the form of double rolls, also called duo-rolls. A drawing arrangement also being known from this utility consisting of draw rolls, neither the draw rolls nor the drawing arrangement are described further in the present application.

In the description, the wrapping angles of the individual bundles of fibrils on the rolls are designated alpha (α), beta (β), gamma (γ) and delta (δ). The total wrapping angle e.g. of the bundle of fibrils 5 is composed of the angle α on the roll 1 and the angle δ on the roll 3 and the one of the bundle of fibrils 6 is composed of the angle β on the roll 2 and the angle γ on the roll 3.

In this arrangement, the difference between the sum of the angles [(β+γ)−(α+δ)] should not exceed 50% of the smaller sum (α+δ).

Also the sum of the wrapping angles about the rolls 1 and 2 for each bundle of fibrils should be substantially 120° or more.

This holds true under consideration of the corresponding number of rolls per bundle of fibrils upstream from the point of transfer to the roll 4 in all the variant embodiments according to the FIGS. 1 through 8.

In the FIG. 2, an arrangement is shown in which the number of rolls is the same as shown in the FIG. 1, the rolls however being arranged differently in such a manner that the rolls 1 and 2 which take up the bundles of fibrils 5 and 6 from their parallel position are arranged horizontally side by side which yields the above mentioned advantage that the distances between these rolls and the corresponding spinneret arrangements are equal. Otherwise the embodiment shown corresponds to the explanations referring to the FIG. 1.

In the FIG. 3, the rolls 1 and 2 are shown arranged in the position same as in the FIG. 1, the roll 3 however together with a displacement roll 13 forming a double roll in such a manner that the total wrapping angles of the bundles of fibres 5 and 6 owing to the multiple wraps attains values exceeding 130° by far and that said difference by the wrapping angles diminishes to values far below the value mentioned of 50°.

The bundles of fibrils 5 and 6 are given off jointly from the rolls 3 and 13 to the draw roll 4.

The variant embodiment shown in the FIG. 4 differs in so far as the bundle of fibrils 5 is taken over by the double roll 3 and 13 directly whereas the bundle of fibrils 6 first is deflected on the roll 2 in such a manner that he distance C between the bundles of fibrils 5 and 6 can be held nearly as small as the diameter of the roll 2. The other characteristics and properties of this variant embodiment and its advantages correspond to the ones mentioned with reference to the FIG. 3.

In the FIG. 5 an alternative embodiment is shown in which, differing from the arrangement shown in the FIG. 2, the bundle of fibrils 5 before being taken over by the roll 3 is deflected by a roll 14. Furthermore the bundle of fibrils 5 is taken over by the roll 1 in the same circumferential direction as the bundle of fibrils 6 by the roll 2.

This embodiment has the advantage that the sum of the wrapping angles α, λ, and δ of the bundle of fibrils 5 essentially is equal to the sum of deflection angles of the angles β and γ of the bundle of fibrils 6. A further advantage is seen in that the distance C in analogy to the advantage mentioned with reference to the FIG. 4 can be chosen almost as small as the diameter of the roll 2.

The further characteristics and properties of the embodiment described correspond to the description of the alternative embodiments mentioned above.

In the FIG. 6 an alternative embodiment similar to the one illustrated in the FIG. 5 is shown, but here the bundle of fibrils is not deflected by the roll 3 but the bundle of fibrils 5, in analogy to the arrangement according to the FIG. 5, is deflected by the roll 14 but is transferred directly to the draw roll 4. The same applies to the bundle of fibrils 6 which after leaving the roll 3 also is transferred directly to the draw roll 4.

In the FIG. 7 the simplest of the variant embodiments is shown in which the bundles of fibrils 5 and 6 each are deflected by one roll only before being transferred to the draw roll 4.

The advantages of this variant embodiment are seen in three points, namely in the possibility of choosing a very small distance C between the two bundles of fibrils, and of obtaining essentially equal wrapping angles of the bundles of fibrils 5 and 6 as the bundles of fibrils each are transferred directly from the rolls 1 and 2 to the draw roll 4 and, thirdly, this variant embodiment offers the most cost-efficient of all the variant embodiments shown in all of which the conditions stipulated initially concerning the maximum admissible difference between the total wrapping angles, and the wrapping angle of 120° or more, are fulfilled.

A similar alternative to the variant embodiment according to the FIG. 7 is shown in the FIG. 8 in which arrangement, however, the rolls taking over the bundles of fibrils 5 and 6 are double rolls, namely the rolls 13 and 14 taking over the bundle of fibrils 5 and the rolls 13 and 3 taking over the bundle of fibrils 6. The bundles of fibrils 5 and 6 each are transferred directly to the draw roll 4. The advantage of this alternative embodiment is seen in that essentially a correspondingly large wrapping angle is obtained for both bundles of fibrils and an equal distance between the rolls 3, and 14 respectively, and the spinneret arrangement is maintained.

In the FIGS. 1A, 2A, 3A, 4A and 5A each a side view is shown according to the respective FIGS. 1 through 5 seen in the viewing direction according to I.

These side views are, as mentioned before, shown schematically in so far as it is known that in an application of double rolls the roll axles extend askew in such a manner that a helical arrangement of the bundles of fibrils can be formed on the rolls such as shown in the FIGS. 1A through 5A for the draw roll 4 and in the FIGS. 3A and 4A for the double roll arrangement of the rolls 3 and 13. The same holds true for the variant embodiments not shown in side views according to the FIGS. 6, 7 and 8.

On the other hand, the rolls 1, 2, 3 and 14 according to the FIGS. 1, 2, 5, 6 and 7 are rolls functioning as deflecting elements i.e. not presenting helical arrangements of the bundles of fibrils.

Furthermore the drivable rolls 1, 2, 3, 13 and 14 each are rotatably mounted on a machine frame 7. The same holds true according to the state of the art for the take-off rolls 10 and the pair of take-off rolls 11 and 12.

The present invention is not restricted to the embodiments shown in the Figures and further alternative embodiments are possible within the scope of the present invention.

What is claimed is:

1. An apparatus in a textile spin draw winding machine for simultaneously drawing at least two adjacent spun bundles of fibrils, comprising:

draw rolls and at least one rotatable deflection roll disposed upstream of said draw rolls in a conveying direction of said bundles of fibrils wherein for each of said bundles of fibrils at least one rotatable deflection roll is provided in its conveying path to said draw rolls;

wherein each said bundle of fibrils defines a respective wrapping angle on its respective said deflection roll such that the difference between said respective wrapping angles does not exceed about 50% of the value of the smaller of said respective wrapping angles; and wherein said bundle of fibrils are deflected in their path to said draw rolls substantially only by said rotatable deflection rolls.

2. The apparatus as in claim 1, comprising a plurality of said deflection rolls whereby at least one of said bundle of fibrils is deflected by more than one said deflection roll, and wherein each of said bundle of fibrils defines a respective total wrapping angle comprised of the sum of individual said wrapping angles on each said deflection roll, and wherein the difference between said total wrapping angles of each said bundle of fibrils does not exceed about 50% of the value of the smaller of said total wrapping angles.

3. The apparatus as in claim 2, wherein said total wrapping angle for each of said bundles of fibrils is greater than about 120 degrees.

4. The apparatus as in claim 2, wherein said plurality of deflection rolls are disposed horizontal and parallel.

5. The apparatus as in claim 2, wherein at least one of said deflection rolls is common to both of said bundles of fibrils such that each said bundle of fibrils defines a different said wrapping angle on said common deflection roll.

6. The apparatus as in claim 5, further comprising at least one additional said deflection roll for each respective said bundle of fibrils.

7. The apparatus as in claim 6 wherein said additional deflection roll is upstream of said common deflection roll in a conveying direction of said bundles of fibrils.

8. The apparatus as in claim 1, wherein said wrapping angles for said respective bundles of fibrils are substantially equal.

9. The apparatus as in claim 1, comprising a plurality of said deflection rolls whereby at least one of said bundle of fibrils is deflected by more than one said deflection roll, and wherein at least two of said deflection rolls are arranged at different vertical heights and each of said bundle of fibrils defines a respective total wrapping angle comprised of the sum of individual said wrapping angles on each said deflection roll, and wherein the difference between said total wrapping angles of each said bundle of fibrils does not exceed about 50% of the value of the smaller of said total wrapping angles.

* * * * *